United States Patent [19]

Kabeta

[11] Patent Number: 4,997,860

[45] Date of Patent: Mar. 5, 1991

[54] SAND CASTING CAKING AGENT

[75] Inventor: Keiji Kabeta, Gunma, Japan

[73] Assignee: Toshiba Silicone Co., Ltd., Tokyo, Japan

[21] Appl. No.: 420,103

[22] Filed: Oct. 11, 1989

[30] Foreign Application Priority Data

Oct. 17, 1988 [JP] Japan ..... 63-261233

[51] Int. Cl.[5] ..... B22C 1/22; C08K 5/54

[52] U.S. Cl. ..... 523/144; 524/262; 523/145; 523/139; 523/146

[58] Field of Search ..... 524/262; 523/145, 144, 523/139, 146

[56] References Cited

U.S. PATENT DOCUMENTS

| | | | |
|---|---|---|---|
| 4,039,503 | 1/1977 | Itoh | 524/262 |
| 4,119,606 | 10/1978 | Teplyakov et al. | 523/144 |
| 4,478,962 | 10/1984 | Woodson | 523/144 |
| 4,818,779 | 4/1989 | Witucki et al. | 524/262 |

*Primary Examiner*—Lewis T. Jacobs
*Assistant Examiner*—Karen A. Hellender.
*Attorney, Agent, or Firm*—Flynn, Thiel, Boutell & Tanis

[57] ABSTRACT

A sand casting caking agent contains an acid-curable resin and an organosilicon compound of the general formula (I):

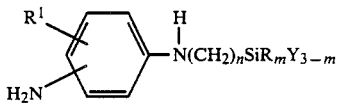

(I)

in which $R^1$ is hydrogen or an alkyl having from 1 to 6 carbon atoms, R is a substituted or nonsubstituted monovalent hydrocarbon group, Y is an alkoxy group having from 1 to 6 carbon atoms, n is an integer of from 1 to 6 and m is either 0 or 1. Casting molds containing the agent of the present invention exhibit superior moisture resistance.

11 Claims, No Drawings

SAND CASTING CAKING AGENT

TECHNICAL FIELD OF THE INVENTION

The present invention is directed to an acid-curable caking agent composition for casting sand and, more specifically, relates to a caking agent for casting sand which provides a cured substance with a high degree of moisture resistance and is composed of an acid-curable resin and a specific organosilicon compound.

PRIOR ART

Commonly known examples of substances that have been used in the past as a caking agent used in the preparation of casting molds and inner molds include phenol resins, furan resins, urea resins, melamine resins as well as their denatured products. In particular, the denatured products are commonly used together with furfuryl alcohol in this particular application.

However, these caking agents have various problems that arise at the time of casting.

For example, when bonding with urea resins or urea-furan resins, there are cases in which pinholes and blowholes are formed by the decomposition of the resin and the gas that is produced at that time.

Although phenol resins are superior in terms of this property, these resins have other problems in terms of practicality due to the occasional occurrence of breakage of the mold or fracturing of the inner mold due to its low final setting strength and brittleness.

If the amount of resin that is added is increased in order to ameliorate these problems, the production of a large volume of gas cannot be avoided, a foul odor results and, furthermore, there are problems in terms of economic feasibility.

It is commonly known that the addition of small amounts of an organosilicon compound is effective in terms of solving these problems.

For example, according to Japanese Patent Publication No. 43-15161 in comparison to not using a silane compound, it is possible to increase by 100-400% the strength of a casting mold and inner mold manufactured by cold self-hardening by using a resin prepared by adding 0.1-3 wt. % of an alkoxysilane of the general formula $R^1Si(OR)_3$ (in which $R^1$ is a lower aliphatic group which possesses the ability to react with the active group of a phenol resin, a urea resin, a melamine resin or a furan resin, which are cured with an acid, or a mixture of these, such as an amino group, an epoxy group, a mercapto group, a hydroxy group, a carbo lower order alkoxy group, a hydroxy lower order alkylamino group, such as a dihydroxyethylamino group, an amino lower order alkylamino group, such as an aminoethylamino group, or a lower order alkenylcarboxy group, such as a methacrylate group, or an alkylene group having 2-6 carbons which possesses a lower order alkenyl group, such as a vinyl group, and R is a lower order alkyl group like a methyl or ethyl group, or a lower order alkoxy group like a methoxyethyl group) to the caking agent as the organosilicon compound.

In addition, in Japanese Patent Publication No. 59-34456, an example is provided in which a dialkoxysilane compound of the general formula

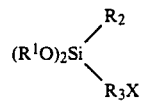

(in which $R^1$ and $R^2$ independently are alkyl, aryl, substituted aryl or heteroalkyl groups, $R^3$ is an alkylene group having 2-6 carbon atoms, and X is an amino group, mercapto group, ureido group, glycidoxy group or aminoalkylamino group) is used as the organosilicon compound. Further, in Japanese Patent Publication No. 43-15161, a method is provided in which a caking agent component having superior storage stability is obtained from an acid-curable casting sand caking agent to which a trialkoxysilane compound has been added.

However, all of the cured products which were prepared using either of these caking agent components had the problem of low moisture resistance, with the deterioration thereof being particularly severe under conditions of high humidity.

OBJECT OF THE INVENTION

The object of the present invention is to correct the problems of the prior art caking agents by providing an acid-curable casting sand caking agent which yields a cured product with improved moisture resistance.

SUMMARY OF THE INVENTION

As a result of earnest studies to obtain an acid-curable casting sand caking agent with improved moisture resistance, the inventors were able to complete the present invention by discovering that the addition of a specific organosilicon compound was extremely effective for this purpose, and confirming such effectiveness.

In other words, the present invention is directed to an acid-curable casting sand caking agent which yields a cured product with improved moisture resistance and comprises as its main ingredient an acid-curable resin and an organosilicon compound of general formula (I):

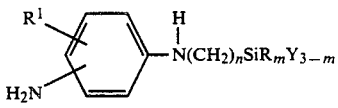

(I)

in which R is a substituted or nonsubstituted monovalent hydrocarbon group, Y is an alkoxy group having 1-6 carbon atoms, n is an integer from 1-6, m is either 0 or 1 and $R^1$ is hydrogen or an alkyl having 1 to 6 carbon atoms.

DESCRIPTION OF THE PREFERRED EMBODIMENT

Examples of the substituted or nonsubstituted monovalent hydrocarbon group, R, in the organosilicon compound of the invention represented in general formula (I) include an alkyl group such as a methyl, ethyl, propyl, butyl or hexyl group, a cycloalkyl group such as a cyclopentyl or cyclohexyl group, an aralkyl group such as a 2-phenylethyl group, an aryl group such as a phenyl or tolyl group, as well as a substituted hydrocarbon group such as a chloromethyl, chlorophenyl or 3,3,3-trifluoromethyl group. However, a methyl group is preferable for reasons of ease of acquisition, etc. In addition, although examples of Y being an alkoxy group having 1–6 carbon atoms include a methoxy group, an ethoxy group, a propoxy group and a butoxy group, based on reactivity and ease of acquisition, alkoxy groups having 1–3 carbon atoms, and in particular, a methoxy group or an ethoxy group, are preferable.

For the value of n in the formula, n=1 or 3 is desirable in terms of ease of acquisition with n=3 being particularly preferable due to stability of the product. Additionally, m is either 0 or 1 and $R^1$ and the amino group may be attached to any position of the phenyl.

Examples of these types of organosilicon compounds include N-{3-(trimethoxysilyl)propyl}-para-phenylenediamine, N-{3-(trimethoxysilyl)propyl}-meta-phenylenediamine, N-{3-(trimethoxysilyl)-propyl}-ortho-phenylenediamine, N-{3-(methyldimethoxysilyl)propyl)-meta-phenylenediamine and N-{3-(methyldimethoxysilyl)propyl}-ortho-phenylenediamine.

These organosilicon compounds are normally synthesized by mixing phenylenediamine and a chloropropylsilane derivative followed by heating and stirring.

Organosilicon compounds having $R^1$ include 2-amino-4-(N-(3-(trimethoxysilyl)propyl))aminotoluene,
4-amino-2-(N-(3-trimethoxysilyl)propyl))aminotoluene,
2-amino-6-(N-(3-trimethoxysilyl)propyl))aminotoluene,
3-amino-4-(N-(3-trimethoxysilyl)propyl))aminotoluene,
4-amino-3-(N-(3-trimethoxysilyl)propyl))aminotoluene,
2-amino-4-(N-(3-(dimethoxymethylsilyl)propyl)-)aminotoluene,
4-amino-2-(N-(3-(dimethoxymethylsilyl)propyl)-)aminotoluene,
2-amino-6-(N-(3-(dimethoxymethylsilyl)propyl)-)aminotoluene,
3-amino-4-(N-(3-(dimethoxymethylsilyl)propyl)-)aminotoluene,
4-amino-3-(N-(3-(dimethoxymethylsilyl)propyl)-)aminotoluene.

The silicon compound having $R^1$ is produced by mixing a diaminoalkylbenzene with a chloropropylsilane compound and heating and stirring the mixture. The reaction temperature ranges from zero ° to 180° C., preferably from 50° to 150° C. The reaction pressure may be atmospheric, below atmospheric or above atmospheric. The use of a solvent may improve the solubility of the starting material and allow easier control of the reaction temperature. The solvent can be hydrocarbon solvents such as toluene, xylene, cyclohexane, n-hexane, n-heptane, naphtha, mineral spirits and petroleum benzine, halogenated hydrocarbons such as chloroform, carbon tetrachloride, trichloroethylene, perchloroethylene and 1,1,1-trichloroethane, ethers such as ethyl ether, tetrahydrofuran, and ethylene glycol diethylether, and non-protonic solvents such as dimethylformamide and dimethylacetoamide. The solvents are chosen so as not to react with the amino group and the alkoxy group of the organosilicon compound. The reaction time, in general, ranges from 0.5 to 8 hours. The reaction product is produced in the form of a hydrochloride. Then it is treated with an amine and a metal alkoxide to remove the hydrochloric acid. Because of the two amino groups attached to the starting material, the product mixture may include an isomeric mixture. The mixture can be used per se for the binder.

The amount of organosilicon compound related to this invention that is added is normally 0.015–5.0 wt. % in the caking agent, and preferably 0.05–2.0 wt. %.

For the resin which is used in this invention, those which are generally used in acid-curable casting sand caking agents, such as furan resins, phenol resins, furfuryl alcohol and urea resins, either individually or in a mixture, are effective. In particular, furan-urea resins or furan-phenol resins, which are prepared by the addition of furfuryl alcohol, are preferably used. In addition, the urea denaturation products, phenol denaturation products and furan denaturation products of these resins are included in the resins usable in this invention.

Normally, in the manufacturing of casting molds or inner molds using this component, fire-resistant particles such as silicon sand or chromite sand are kneaded together with the curing agent.

Although commonly known inorganic acid-type and organic acid-type curing agents are normally used (typical examples of inorganic acid-curing agents include aqueous solutions or nonaqueous solvent solutions of sulfuric acid or phosphoric acid and typical examples of organic acid-curing agents include aqueous solutions or nonaqueous solvent solutions of sulfonic acid such as benzene sulfonic acid, toluene sulfonic acid and xylene sulfonic acid) for the curing agent, the curing agents usable in the present invention are not limited thereto.

The acid-curable casting sand caking agent of the present invention improves the moisture resistance of the molds following curing as compared with conventionally used caking agents.

This makes it possible to reduce costs in terms of making highly moisture resistant casting molds and further, also results in a reduction in the amount of gas produced at the time of casting, thereby making it useful in reducing casting defects caused by the production of gas.

EXAMPLES

The following provides a more detailed explanation of the invention by giving examples of the present invention. Within the descriptions of the examples, the term "parts" refers to "parts by weight". In addition, the following examples do not limit this invention. Further, the symbol "Me" shown in the formulae indicates a methyl group.

EXAMPLES 1–5, COMPARATIVE EXAMPLES 1 and 2

2 parts of curing agent (#150B, Kobe Scientific Industries, Ltd.) was added to 400 parts of casting silica sand and stirred for 1 minute. Next, 4 parts of a furan resin (XFURAN #522B, Kobe Scientific Industries, Ltd.), in which 0.02 parts of the organosilicon compounds indicated in Table 1 were dissolved, were added thereto and stirred therein for an additional minute. This mixture was then immediately transferred to four containers having a size of 50 mm×50 mmo and cured for 24 hours at 20° C. and 55% RH. Then, each of the mixtures was removed from their respective container and two were allowed to stand for an additional 24 hours under the same conditions while the other two were allowed to stand for an additional 24 hours in sealed containers containing water so as not to come in contact with the water. Following this, the resisting pressure of each of the test pieces was measured. The test results are indicated in Table 1 with each of the values being the average value of 2 test pieces.

TABLE 1

| Examples | Structural Formula of Organosilicon Compound | Test Results (kg/cm²) Standing in Air(1) | Standing over Water(2) |
|---|---|---|---|
| 1 | 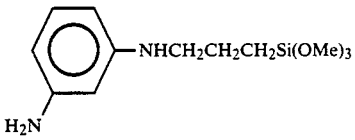 | 53 | 28 |
| 2 | 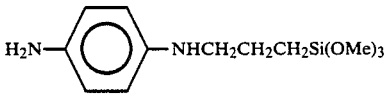 | 53 | 28 |
| 3 | 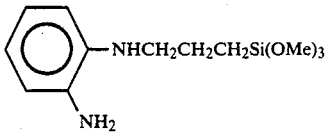 | 52 | 27 |
| 4 | 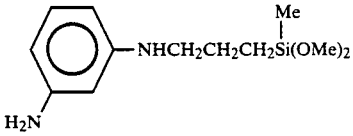 | 53 | 28 |
| 5 | 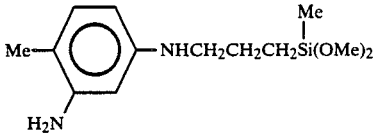 | 53 | 28 |
| Comparative Example 1 | $H_2NCH_2CH_2NHCH_2CH_2CH_2Si(OMe)_2$ (Me) | 52 | 20 |
| Comparative Example 2 | $H_2NCH_2CH_2NHCH_2CH_2CH_2Si(OMe)_3$ | 52 | 20 |

(1)Results after standing at 20° C. and 55% RH
(2)Results after standing in sealed container over water

EXAMPLE 6

In a reactor equipped with a cooling tube having a drying tube, 122 parts of 2,4-diaminotoluene and 66 parts of gamma-chloropropyltrimethoxysilane were reacted with each other at 110° C. for 10 hours, while being stirred. The product mixture was cooled to 50° C. and 60 parts of methanol was added thereto. Then, 71 parts of 25 wt. % solution in methanol of sodium methylate was added thereto and the mixture was agitated for 30 minutes. Formed salts were removed and 27 parts of a light yellow, transparent liquid was obtained by distillation at 0.5 Torr. at 195° to 200° C. An analysis of the liquid found it to be a mixture of 2-amino-4-(N-(3-trimethoxysilyl)propyl))aminotoluene and 4-amino-2-(N-(3-trimethoxysilyl)propyl))aminotoluene. Analytical data follows:

| | | |
|---|---|---|
| NMR (90 MHz, $CCl_4$, δ), | 0.57–0.83 | (m,2H,Si—$CH_2$) |
| | 1.43–1.93 | (m,2H,Si—C—$CH_2$) |

-continued

| | | | |
|---|---|---|---|
| | | 2.20 | (S,3H,Ph-$CH_3$) |
| | | 3.10 | (t,J = 7Hz,2H,N—$CH_2$) |
| | | 3.60 | (s,9H,O—$CH_3$) |
| | | 4.07 | (s,3H,NH) |
| | | 6.03–7.10 | (m,3H,aromatic) |
| IR ($cm^{-1}$) | | 3400, 3350, 3210, 3020, 2960, 2850, 1630, 1620 | |
| Mass ($M^+$) | | 284 | |
| | | found | calculated |
| element | C | 54.65 | (54.90) |
| analysis | H | 8.69 | (8.51) |

EXAMPLE 7

The same reaction as shown in Example 6 was conducted except for replacing gamma-chloropropyltrimethoxysilane by 60 parts of gamma-chloropropyldimethoxymethylsilane. A fraction distilled out at 190° to 197° C. at 0.5 Torr. included 24 parts of a light yellow, transparent liquid. It was found to be a mixture 2-amino- 4-(N-(3-(dimethoxymethylsilyl)propyl))aminotoluene and 4-amino-2-(N-(3-(dimethoxymethylsilyl)propyl))aminotoluene. Analytical data follows:

| | | | |
|---|---|---|---|
| NMR (90 MHz, $CCl_4$, δ), | | 0.07 | (m,2H,Si—$CH_3$) |
| | | 0.57–0.83 | (m,2H,Si—$CH_2$) |
| | | 1.43–1.93 | (m,2H,Si—C—$CH_2$) |
| | | 2.20 | (s,3H,Ph-$CH_3$) |
| | | 3.10 | (t,J = 7Hz,2H,N—$CH_2$) |
| | | 3.60 | (s,6H,O—$CH_3$) |
| | | 4.00 | (s,3H,NH) |
| | | 6.03–7.10 | (m,3H,aromatic) |
| IR ($cm^{-1}$) | | 3400, 3350, 3200, 2950, 2850, 1630, 1260 | |
| Mass ($M^+$) | | 286 | |
| | | found | calculated |
| element | C | 57.99 | (58.17) |
| analysis | H | 9.13 | (9.01) |

400 parts of silicate sand for casting and 2 parts of a curing agent, #150B of Kobe Scientific Industries, Ltd., were mixed with each other and the mixture was stirred for 1 minute. 4 parts of a furan resin, XFURAN #522B of Kobe Scientific Industries, Ltd., containing 0.02 part of an organic silicon compound shown in Table 2 and dissolved therein, was added to the mixture and stirred therein for one more minute. Four containers having 50 mm length and 50 mm diameter were each charged with the mixture. Each sample of the mixture was cured at 20° C. at 55% RH for 24 hours. Two samples were taken out of the container and then allowed to stand as they were for 24 hours. The other two samples were kept in a separate, sealed container containing water, but not so as to come into contact with the water, for 24 hours. Each sample was examined with respect to pressure resistance. The data in Table 2 is an average of the two samples.

TABLE 2

| Example | Organosilicon Compound | (kg/cm²) 20° C. at RH | Above Water |
|---|---|---|---|
| 6 | Compound of Example 6 | 53 | 28 |
| 7 | Compound of Example 7 | 53 | 28 |
| Comparative Ex. 3 | $H_2NCH_2CH_2NHCH_2CH_2CH_2Si(OMe)_2$ (Me) | 52 | 20 |
| Comparative Ex. 4 | $H_2NCH_2CH_2NHCH_2CH_2CH_2Si(OMe)_3$ | 52 | 20 |

What is claimed is:

1. A sand casting caking agent comprising an acid-curable resin and an organosilicon compound, said organosilicon compound being of general formula (I):

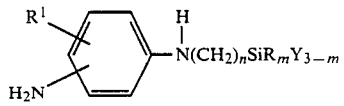

(I)

in which $R^1$ is hydrogen or an alkyl having from 1 to 6 carbon atoms, R is a substituted or nonsubstituted monovalent hydrocarbon group, Y is an alkoxy group having from 1 to 6 carbon atoms, n is an integer of from 1 to 6 and m is either 0 or 1.

2. The caking agent of claim 1, wherein $R^1$ is an alkyl having from 1 to 6 carbon atoms.

3. The caking agent of claim 1, wherein $R^1$ is a methyl group.

4. The caking agent of claim 1, wherein said organosilicon compound is

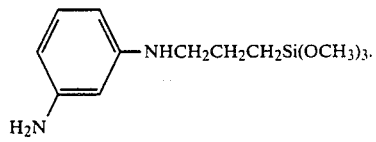

5. The caking agent of claim 1, wherein said organosilicon compound is

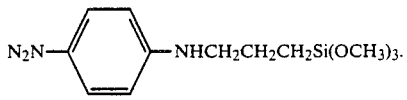

6. The caking agent of claim 1, wherein said organosilicon compound is

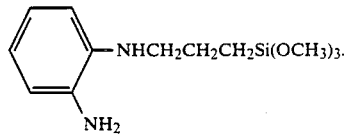

7. The caking agent of claim 1, wherein said organosilicon compound is

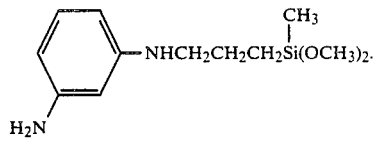

8. The caking agent of claim 1, wherein said organosilicon compound is 2-amino-4-(N-(3-trimethoxysilyl)propyl))aminotoluene.

9. The caking agent of claim 1, wherein said organosilicon is 4-amino-2-(N-(3-(trimethoxysilyl)propyl))aminotoluene.

10. The caking agent of claim 1, wherein said organosilicon compound is 2-amino-4-(N-(3-(dimethoxymethylsilyl)propyl))aminotoluene.

11. The caking agent of claim 1, wherein said organosilicon compound is 4-amino-2-(N-(3-(dimethoxymethylsilyl)propyl))aminotoluene.

* * * * *